US009522800B2

(12) United States Patent
Garner et al.

(10) Patent No.: US 9,522,800 B2
(45) Date of Patent: Dec. 20, 2016

(54) METHODS AND APPARATUSES FOR CONVEYING FLEXIBLE GLASS SUBSTRATES

(71) Applicant: Corning Incorporated, Corning, NY (US)

(72) Inventors: Sean Matthew Garner, Elmira, NY (US); Nikolay Anatolyevich Panin, Painted Post, NY (US)

(73) Assignee: CORNING INCORPORATED, Corning, NY (US)

( * ) Notice: Subject to any disclaimer, the term of this patent is extended or adjusted under 35 U.S.C. 154(b) by 0 days.

(21) Appl. No.: 15/060,714

(22) Filed: Mar. 4, 2016

(65) Prior Publication Data

US 2016/0185545 A1 Jun. 30, 2016

Related U.S. Application Data

(62) Division of application No. 13/307,235, filed on Nov. 30, 2011.

(51) Int. Cl.
*B65H 23/00* (2006.01)
*B65H 18/10* (2006.01)
(Continued)

(52) U.S. Cl.
CPC ..... *B65H 18/103* (2013.01); *B65H 23/32* (2013.01); *B65H 29/70* (2013.01);
(Continued)

(58) Field of Classification Search
CPC ..... B65H 18/00; B65H 18/02; B65H 18/145; B65H 2801/61
(Continued)

(56) References Cited

U.S. PATENT DOCUMENTS 1,569,724 A 1/1926 Dimond
2,595,325 A 5/1952 Baumgartner
(Continued)

FOREIGN PATENT DOCUMENTS

JP 1969009701 5/1969
JP 62036263 A 2/1987
(Continued)

OTHER PUBLICATIONS

Byon et al.; "Effect of roll gap adjustment on exit cross sectional shape in groove rolling—Experimental and FE analysis"; Journal of Materials Processing Technology 209 (2009); pp. 4465-4470.
(Continued)

*Primary Examiner* — William A Rivera
(74) *Attorney, Agent, or Firm* — Kevin M. Able

(57) ABSTRACT

An apparatus for redirecting a glass ribbon assembly from a first glass conveyance path to a second glass conveyance path. The apparatus includes a glass ribbon assembly source for providing the glass ribbon assembly including a flexible glass substrate that includes a first surface and a second surface that extend between a first edge and a second edge, first and second handling tabs affixed to the flexible glass substrate edges, and a primary roll member located downstream of the glass ribbon assembly source. The first glass conveyance path extends from the glass ribbon assembly source to the primary roll member, and the second glass conveyance path extends from the primary roll member in a downstream direction. Contact surfaces of the primary roll member are tangential to the first and second glass conveyance paths, and the second glass conveyance path is non-planar with the first glass conveyance path.

12 Claims, 8 Drawing Sheets

(51) Int. Cl.
*B65H 23/32* (2006.01)
*B65H 29/70* (2006.01)

(52) U.S. Cl.
CPC ..... *B65H 2301/51214* (2013.01); *B65H 2404/743* (2013.01); *B65H 2406/111* (2013.01); *B65H 2406/1115* (2013.01); *B65H 2801/61* (2013.01)

(58) Field of Classification Search
USPC ..... 242/548, 548.1, 548.2, 548.3, 548.4, 566,242/615, 615.11, 615.3; 226/88
See application file for complete search history.

(56) References Cited

U.S. PATENT DOCUMENTS

| | | | | |
|---|---|---|---|---|
| 5,585,188 | A | 12/1996 | Cheron et al. | |
| 5,967,394 | A | 10/1999 | Crowley et al. | |
| 6,032,843 | A | 3/2000 | Juergens, III | |
| 6,668,473 | B2 | 12/2003 | Schoening | |
| 7,017,853 | B2 | 3/2006 | Colson et al. | |
| 9,034,458 | B2 * | 5/2015 | Li ..... | B65D 85/48 428/192 |
| 2010/0260964 | A1 | 10/2010 | Nakamura et al. | |
| 2011/0023548 | A1 | 2/2011 | Garner et al. | |
| 2011/0177325 | A1 | 7/2011 | Tomamoto et al. | |
| 2011/0223386 | A1 | 9/2011 | Tomamoto et al. | |
| 2012/0247154 | A1 * | 10/2012 | Abramov ..... | C03B 33/0235 65/54 |
| 2012/0255672 | A1 | 10/2012 | Marshall et al. | |
| 2013/0134202 | A1 * | 5/2013 | Garner ..... | B65H 23/32 226/6 |

FOREIGN PATENT DOCUMENTS

| | | | |
|---|---|---|---|
| JP | 2001196438 | A | 7/2001 |
| JP | 2006206320 | A | 8/2006 |
| JP | 2011178490 | A | 9/2011 |
| WO | 2006121709 | A1 | 11/2006 |

OTHER PUBLICATIONS

Japanese Patent Office; Notice of Grounds for Rejection for Japanese Application No. 2014-544907; Issue Date: Aug. 2, 2016; pp. 1-5.

* cited by examiner

METHODS AND APPARATUSES FOR CONVEYING FLEXIBLE GLASS SUBSTRATES

This is a divisional of U.S. patent application Ser. No. 13/307,235 filed on Nov. 30, 2011, the content of which is relied upon and incorporated herein by reference in its entirety, and the benefit of priority under 35 U.S.C. §120 is hereby claimed.

BACKGROUND

Field

The present specification generally relates methods and apparatuses for conveying flexible glass substrates and, more specifically, to methods and apparatuses for minimizing contact between flexible glass substrates and roller elements as the flexible glass substrates are conveyed and redirected.

Technical Background

Thin flexible glass substrates can be used in a variety of applications, including so-called "e-paper," color filters, photovoltaic cells, displays, OLED lighting, and touch sensors. The glass for such substrates can be quite thin, typically less than about 0.3 mm. The processing of the substrates can be performed on an individual glass sheet basis, or most efficiently, by conveying the substrate as a long glass ribbon, or web, wound on a roll, or spool. Such methods include dispensing the ribbon from one roll, processing the dispensed portion, then re-winding the ribbon onto a take-up roll. Alternatively, the glass ribbon can be singulated into discrete components or sheets instead of the final re-winding onto a take-up roll.

One drawback to a so-called "roll-to-roll" process is the brittleness of the thin glass ribbon. Specifically, mechanical contact of the ribbon during handling can lead to damage, including scratches, chipping, and fracture. What is needed are methods and apparatuses for conveying the flexible glass substrate without damaging the glass or any fabricated device structures that may exist on the glass surfaces.

SUMMARY

The embodiments described herein relate to methods and apparatuses for conveying and redirecting a flexible glass ribbon assembly while minimizing the likelihood of damage to the glass ribbon assembly or any fabricated device structures on the glass surfaces as the glass ribbon assembly is redirected from a first plane into a second plane. Specifically, the methods and apparatuses described herein prevent contact between the flexible glass substrate or device structures and roll members of a conveying apparatus thereby reducing the likelihood of damage to the flexible glass substrate or fabricated devices during handling and processing.

According to one embodiment, a method of redirecting a glass ribbon assembly to avoid contact with a glass substrate of the glass ribbon assembly or fabricated device includes conveying the glass ribbon assembly structures in a conveyance direction on a first glass conveyance path. The glass ribbon assembly includes a flexible glass substrate having a first surface and a second surface that extend laterally between a first edge and a second edge, a first handling tab affixed to the first edge, and a second handling tab affixed to the second edge. The first handling tab and the second handling tab extend above and below the flexible glass substrate and define a handling surface envelope in which the flexible glass substrate is positioned when the first surface and the second surface are planar. The method also includes supporting the glass ribbon assembly on the first handling tab and the second handling tab such that the flexible glass substrate is free to flex out of the handling surface envelope while remaining spaced apart from a primary roll member when the flexible glass substrate is directed around the primary roll member. The method further includes directing the glass ribbon assembly around the primary roll member such that the glass ribbon assembly is redirected from the first glass conveyance path to the second glass conveyance path.

In another embodiment, an apparatus for redirecting a glass ribbon assembly to avoid contact with a glass substrate of the glass ribbon assembly or fabricated devices includes a glass ribbon assembly source which provides a glass ribbon assembly that includes a flexible glass substrate having a first surface and a second surface that extend laterally between a first edge and a second edge, a first handling tab affixed to the first edge, and a second handling tab affixed to the second edge. The first handling tab and the second handling tab extend above and below the flexible glass substrate and define a handling surface envelope. The apparatus also includes a primary roll member located downstream of the glass ribbon assembly source. The primary roll member includes a first cylindrical contact surface and a second cylindrical contact surface spaced apart from the first cylindrical contact surface along a roller element axis. The flexible glass substrate of the glass ribbon assembly is free to flex out of the handling surface envelope while remaining spaced apart from the primary roll member. The apparatus further includes a first glass conveyance path extending from the glass ribbon assembly source to the primary roll member. The first cylindrical contact surface and the second cylindrical contact surface of the primary roll member are positioned to be tangential to the first glass conveyance path. The apparatus also includes a second glass conveyance path extending from the primary roll member in a downstream direction. The first cylindrical contact surface and the second cylindrical contact surface of the primary roll member are tangential to the second glass conveyance path and the second glass conveyance path is non-planar with the second glass conveyance path.

In yet another embodiment, a method of redirecting a glass ribbon assembly to avoid contact with a glass substrate of the glass ribbon assembly or fabricated device includes conveying the glass ribbon assembly in a conveyance direction on the first glass conveyance path. The glass ribbon assembly includes a flexible glass substrate having a first surface and a second surface that extend laterally between a first edge and a second edge. The first surface and the second surface define a handling surface envelope in which the flexible glass substrate is positioned when the first surface and the second surface are planar. The method also includes supporting the glass ribbon assembly on a primary roll member that includes a first cylindrical contact surface and a second cylindrical contact surface spaced apart from the first cylindrical contact surface along a roller element axis. The glass ribbon assembly is supported by the first and second cylindrical contact surfaces at positions proximate to the first edge and the second edge of the flexible glass substrate. The flexible glass substrate is free to flex out of the handling surface envelope while remaining spaced apart from a primary roll member at positions between the first cylindrical contact surface and the second cylindrical contact surface when the flexible glass substrate is directed around the primary roll member. The method further includes directing the glass ribbon assembly around the primary roll member such that the glass ribbon assembly is redirected along from the first glass conveyance path to the second glass conveyance path.

Additional features and advantages of the invention will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
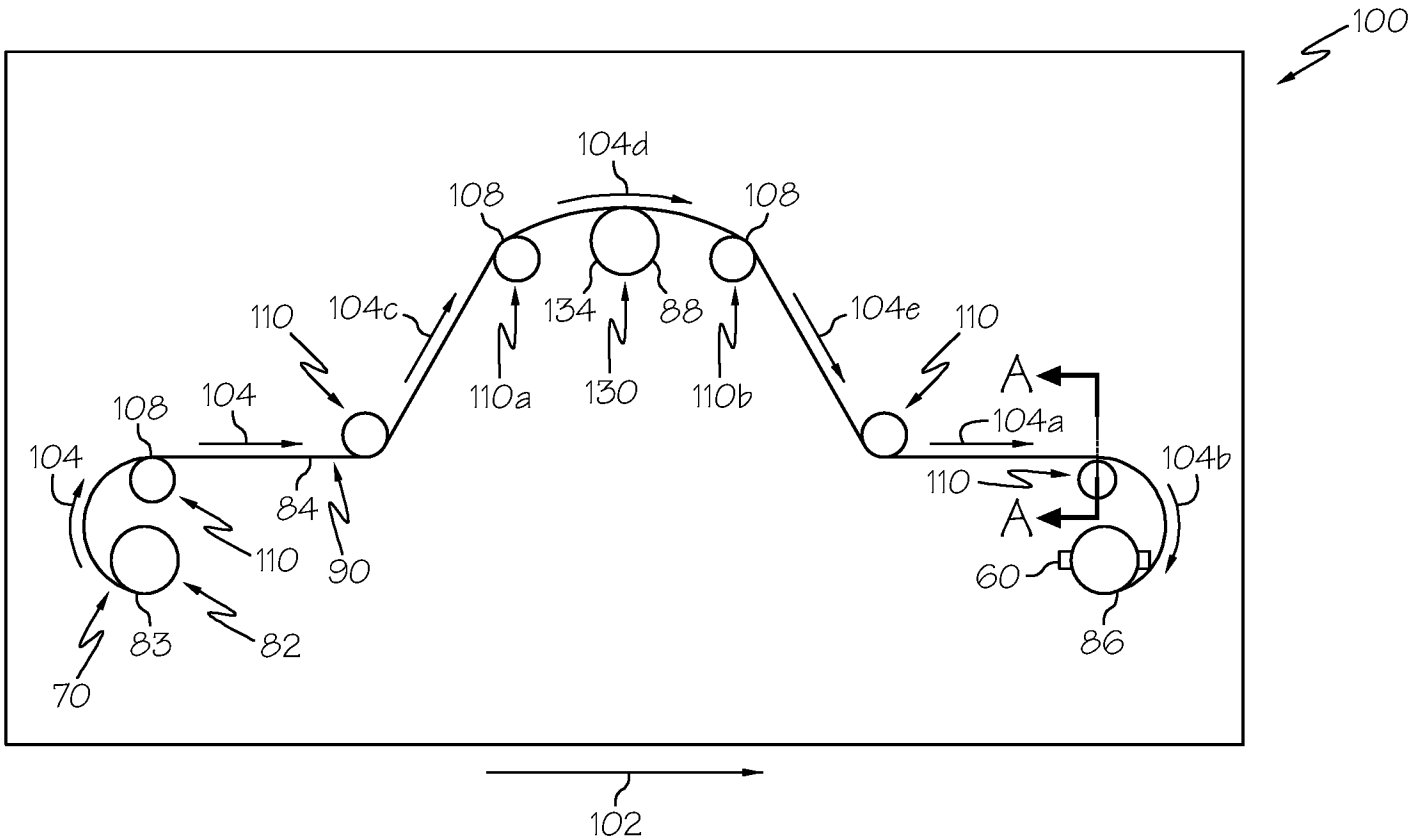
FIG. 1 schematically depicts an apparatus for conveying a glass ribbon assembly including primary roll members according to one or more embodiments shown or described herein.

Reference will now be made in detail to embodiments of methods and apparatuses for conveying and redirecting flexible glass substrates, examples of which are illustrated in the accompanying drawings. Whenever possible, the same reference numerals will be used throughout the drawings to refer to the same or like parts. In one embodiment, a method of redirecting a glass ribbon assembly includes conveying the glass ribbon assembly along a first glass conveyance path. The glass ribbon assembly comprises a flexible glass substrate that includes a first surface and a second surface that extend laterally between a first edge and a second edge. First and second handling tabs are affixed to the first and second edges. The handling tabs extend above and below the flexible glass substrate and define a handling surface envelope in which the flexible glass substrate is positioned when the first surface and the second surface are planar. The glass ribbon assembly is supported on the first and second handling tabs such that the flexible glass substrate is free to flex outside of the handling surface envelope while remaining spaced apart from a primary roll member when the flexible glass substrate is directed around the primary roll member. For example, the handling tabs together create a gap between the flexible glass substrate and the roll member. The method further includes directing the glass ribbon assembly around a primary roll member such that the glass ribbon assembly is redirected from the first glass conveyance path to the second glass conveyance path. The methods of redirecting a glass ribbon assembly from a first glass conveyance path to a second glass conveyance path and apparatuses for performing the method will be described in further detail herein with specific reference to the appended drawings.

While glass is generally known as a brittle material, inflexible and prone to scratching, chipping and fracture, glass having a thin cross section can in fact be quite flexible. Glass in thin sheets or ribbons can be wound and un-wound from rolls, much like paper or plastic film. However, even though glass can be made flexible, it retains its brittle characteristic, and can be damaged by contact. For certain applications, particularly those for which visual defects can be distracting (e.g., display applications), even minor, seemingly cosmetic defects are unacceptable. For other applications requiring high mechanical strength, defects even less than 1 μm can limit the mechanical reliability of the glass substrate. Thus, handling of the glass substrates during a manufacturing process, such as the deposition of thin film coatings onto the glass substrate, can become a source of loss and high cost. Additionally, as device structures are fabricated on the flexible glass surfaces, contact with the device structures can result in damage to the device structures and significant reduction in manufacturing yield.

In order to minimize contact with the glass substrate or device structures fabricated on the glass surfaces during roll-to-roll or sheet-fed roll processing, handling tabs may be attached to the edges of a flexible glass substrate, as described in U.S. patent application Ser. No. 12/511,167 entitled "Flexible Glass Substrate Comprising an Edge Web Portion" assigned to Corning, Inc. These handling tabs serve a variety of different functions. For example, the handling tabs provide a mechanism by which the flexible glass substrate can be conveyed and/or mechanically handled without touching the surface of the glass. Moreover, because the handling tabs extend over a portion of the top and bottom surfaces of the flexible glass substrate adjacent to each edge of the flexible glass substrate, the handling tabs may also be utilized as spacers to prevent contact with the surface of the flexible glass substrate or any device structures fabricated on the glass surfaces. For example, when a thin flexible glass substrate is wound onto a storage spool, the handling tabs prevent the surfaces of adjacent layers of glass from contacting one another thereby preventing damage to the glass. In addition to the existing handling tabs that are positioned both above and below the glass surfaces, other variations of the handling tabs are contemplated, as described in the patent application referenced above.

While the handling tabs make it possible to prevent contact with the surface of the flexible glass substrate during most processing and/or manufacturing operations, the present inventors have determined that the handling tabs may not prevent all contact with the glass surface or devices structures fabricated on the glass surfaces during processing. Specifically, as a flexible glass substrate is redirected through different processing stages, one or more rollers may be utilized to convey the flexible glass substrate from stage to stage and redirect the flexible glass substrate along different glass conveyance paths. The present inventors have determined that as the flexible glass substrate with handling tabs transitions from a flat or planar state to a curved state, such as when the flexible glass substrate is redirected around a cylindrical roller, the center portion of the flexible glass substrate may flex and may make contact with the roller, potentially damaging the surface of the flexible glass substrates. Additionally, instabilities, perturbations, vibrations, and transient effects that may exist in manufacturing environments or in processing and handling equipment may also cause intermittent or extended contact to occur between flexible glass substrate and the roller handling system. The methods and apparatuses described herein mitigate contact between the flexible glass substrate or device structures fabricated on the glass surfaces and the roller during handling, including where the flexible glass substrate transitions from a planar state to a curved state around a roller.

Although glass can be processed on an individual sheet basis, "roll-to-roll" processing of the glass ribbon allows for an efficient method of processing that involves starting with a glass ribbon assembly paid out from a glass ribbon assembly source. For example, the glass ribbon assembly source may include the glass ribbon assembly wound on a pay-out roll, as depicted in FIG. 1 and described below. However, as described below, other embodiments of the glass ribbon assembly source are contemplated. As the glass ribbon assembly is unwound from the pay-out roll, the unwound or dispensed portion can be processed, and then rewound on a take-up roll. In this context, the term "processed" can include any step subsequent to the formation of the glass, including but not limited to cleaning, slitting, laminating, or the deposition of additional layers and/or components (e.g. electrical/electronic components or portions thereof) on the glass. In addition to full roll-to-roll processing, processing of the flexible glass with sheet-fed roller systems is also possible to perform similar actions.

FIG. 1 schematically depicts an apparatus 100 for conveying a glass ribbon assembly 90 from a glass ribbon assembly source 70, such as a pay-out roll 82 and/or upstream processing equipment. The apparatus 100 generally comprises at least one primary roll member 110 and at least one functional roller 130. In the embodiment of the apparatus 100 depicted in FIG. 1, the apparatus 100 further comprises a pay-out roll 82 and a take-up roll 86, along with a plurality of primary roll members 110. As a draw tension is applied to the glass ribbon assembly 90 the glass ribbon assembly 90 advances through the apparatus 100 in a conveyance direction 102 through a plurality of glass conveyance paths 104. As the glass ribbon assembly 90 passes through the apparatus 100, the glass ribbon assembly 90 is redirected through a plurality of orientations such that the glass ribbon assembly 90 can be processed between the pay-out roll 82 and the take-up roll 86. In the embodiment depicted in FIG. 1, the primary roll members 110 and the functional rollers 130 facilitate redirecting the flexible glass substrate 92 as the glass ribbon assembly 90 is conveyed in the conveyance direction 102. The primary roll members 110 and the functional rollers 130 are positioned in the apparatus 100 relative to one another such that the axes of rotation of the components are substantially parallel with one another. The glass ribbon assembly 90 is conveyed through a plurality of orientations as the glass ribbon assembly 90 travels through the apparatus 100 in the conveyance direction 102.

Figure 2:
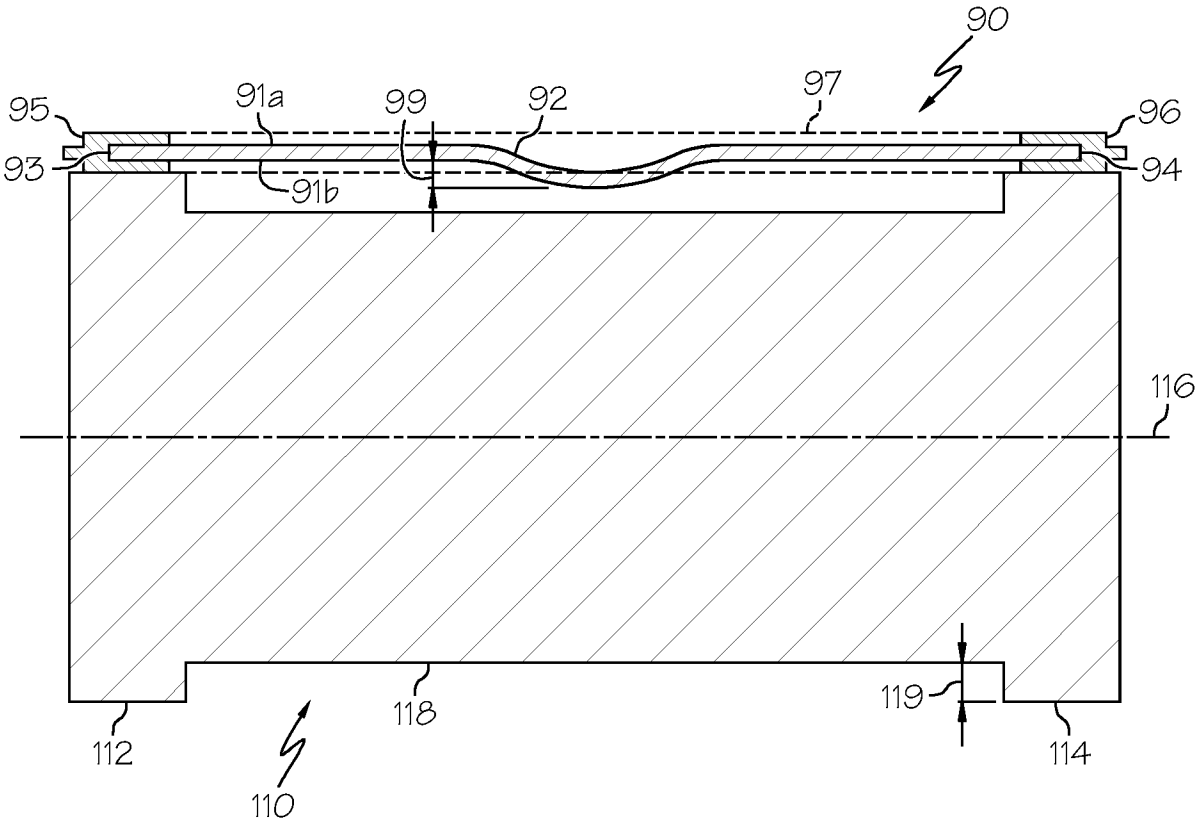
FIG. 2 schematically depicts a front view of a primary roll member and a glass ribbon assembly shown along line A-A of FIG. 1.

Referring now to FIG. 2, one embodiment of a glass ribbon assembly for use with the methods and apparatuses described herein is schematically depicted. The glass ribbon assembly 90, includes a flexible glass substrate 92 having a first and a second surface 91*a*, 91*b* that extend laterally between a first edge 93 and a second edge 94. A first handling tab 95 is attached to the first edge 93 and a second handling tab 96 is attached to the second edge 94. As illustrated in FIG. 2, the handling tabs 95, 96 extend above and below the flexible glass substrate 92, and define a handling surface envelope 97 around the perimeter of the glass ribbon assembly 90. The flexible glass substrate 92 is positioned within the handling surface envelope 97 when the first surface 91*a* and the second surface 91*b* of the flexible glass substrate are substantially planar (i.e., when the flexible glass substrate is not flexed or otherwise deformed). One method for forming the handling tabs 95, 96 on the flexible glass substrate 92 is described in U.S. patent application Ser. No. 13/083,960 entitled "METHODS AND APPARATUSES FOR APPLYING A HANDLING TAB TO CONTINUOUS GLASS RIBBONS" and assigned to Corning, Inc. However, it should be understood that other methods for forming the handling tabs on the flexible glass substrate are contemplated.

Still referring to FIG. 2, a primary roll member 110 of the apparatus 100 is also schematically depicted. The primary roll member 110 is generally constructed to prevent contact between the flexible glass substrate 92 of the glass ribbon assembly 90 and the primary roll member 110 as the glass ribbon assembly 90 is redirected by the primary roll member 110. Specifically, the primary roll member 110 generally includes a first cylindrical contact surface 112 and a second cylindrical contact surface 114 spaced apart from the first cylindrical contact surface 112 along the roller element axis 116. In the embodiment depicted in FIG. 2, the primary roll member 110 further includes a center section 118 positioned between the first cylindrical contact surface 112 and the second cylindrical contact surface 114. The center section 118 joins the first cylindrical contact surface 112 and the second cylindrical contact surface 114, such as when the first cylindrical contact surface 112, the second cylindrical contact surface 114, and the center section 118 are integrally formed with one another. However, it should be understood that the first cylindrical contact surface 112, the second cylindrical contact surface 114, and the center section 118 may be formed as separate components and joined together by welding and/or mechanical fasteners such as screws, bolts, or the like. In the embodiments described herein, the center section 118 is offset radially inward from the first cylindrical contact surface 112 and the second cylindrical contact surface 114 by a relief distance 119 in order to prevent contact between the flexible glass substrate 92 and the center section 118 when the glass ribbon assembly is redirected around the primary roll member 110.

Figure 3:
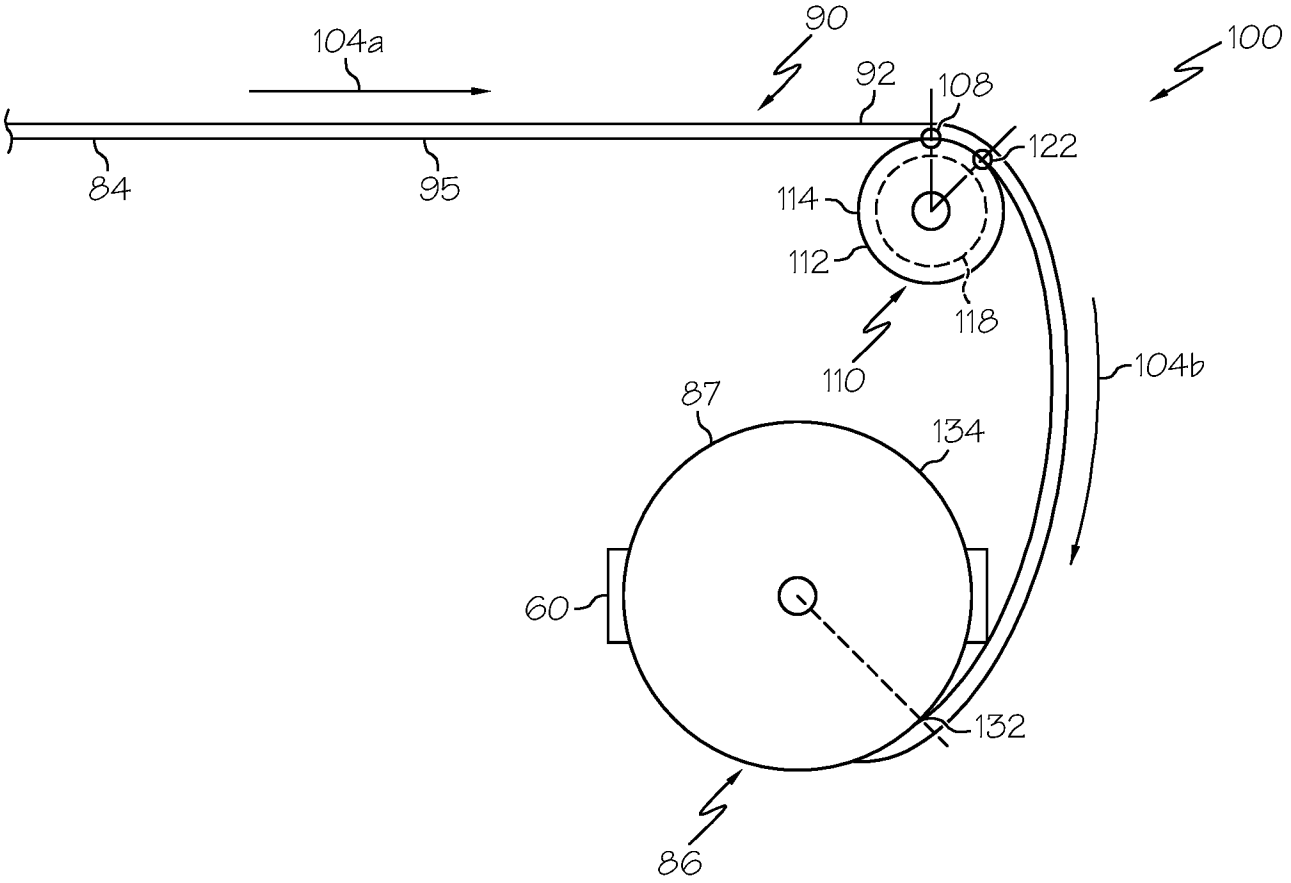
FIG. 3 schematically depicts a portion of the apparatus for conveying a glass ribbon assembly of FIG. 1.

Referring now to FIG. 3, a portion of the apparatus 100 of FIG. 1 is schematically depicted. This portion of the apparatus 100 includes the take-up roll 86, which is located downstream of the primary roll member 110 and provides a mechanism for both winding and storing the glass ribbon assembly 90 as well as a mechanism for applying a draw tension to the glass ribbon assembly 90. The take-up roll 86 has a collection diameter 87 that is tangential to the second glass conveyance path 104*b*. The take-up roll 86 is coupled to a drive mechanism 60 that rotates the take-up roll 86, thereby applying the draw tension to the glass ribbon assembly 90 and winding the glass ribbon assembly 90 onto the take-up roll 86.

As shown in FIG. 3, the glass ribbon assembly 90 is conveyed along a first glass conveyance path 104*a* in a planar orientation and passes over the primary roll member 110, where the glass ribbon assembly 90 is redirected by the primary roll member 110 from the first glass conveyance path 104*a* to a second glass conveyance path 104*b* in which the glass ribbon assembly 90 is curved. When the glass ribbon assembly 90 is in the curved orientation of the second glass conveyance path 104*b*, as depicted in FIG. 3, the glass ribbon assembly 90 can readily be introduced to a take-up roll 86 having a generally cylindrical shape without the flexible glass substrate 92 flexing inwards and contacting the take-up roll 86. The primary roll member 110 is positioned in the apparatus 100 such that the first and second cylindrical contact surfaces 112, 114 of the primary roll member 110 are tangential to the first glass conveyance path 104*a*. In addition, the primary roll member 110 and the take-up roll 86 are positioned relative to one another such that the second glass conveyance path 104*b* between a tangential take-out point 122 of the primary roll member 110 and a tangential collection point 132 of the take-up roll 86 is non-planar with the first glass conveyance path 104*a*. The second glass conveyance path 104*b* is tangential to the first cylindrical contact surface 112 and second cylindrical contact surface 114 of the primary roll member 110, along with the collection diameter 87 of the take-up roll 86. Thus, the portion of the glass ribbon assembly 90 in the second glass conveyance path 104*b* that is positioned between the primary roll member 110 and the take-up roll 86 is non-planar with the portion of the glass ribbon assembly 90 in the first glass conveyance path 104*a*. For example, the roll member 110 causes an initial bend in the flexible glass substrate 92 of the glass ribbon assembly 90. This bend continues in the flexible glass substrate 92 as the glass ribbon assembly 90 is introduced to the take-up roll 86. Any instabilities in the flexible glass substrate 92 or potential contact between the flexible glass substrate 92 and the roll member 110 that might occur when transitioning from a substantially flat state in conveyance path 104*a* to a curved state in conveyance path 104*b* while being directed around roll member 110 are minimized by the configuration of the roll member 110 that includes the center section 118 offset radially inward from the first and second cylindrical contact surfaces 112, 114. Roll member 110 and take-up roll 86 are positioned relative to one another such that the flexible glass substrate 92 is not positioned in a flat state while being directed between the roll member 110 and the take-up roll 86.

Referring again to FIG. 2, the glass ribbon assembly 90 engages with the primary roll member 110 such that the first and second handling tabs 95, 96 contact the first and second cylindrical contact surfaces 112, 114 of the primary roll member 110, respectively. The portion of the flexible glass substrate 92 between the first and second handling tabs 95, 96 is therefore positioned over and spaced apart from the center section 118 of the primary roll member 110. Accordingly, the glass ribbon assembly 90 is supported at its edges 93, 94 on the first and second handling tabs 95, 96 as a tension force is applied to the glass ribbon assembly 90 to convey the glass ribbon assembly 90. As noted hereinabove, the flexible glass substrate 92, the center portion of which is without direct support from the primary roll member 110, has a tendency to flex inwards, towards the primary roll member 110 as the glass ribbon assembly is directed around the primary roll member 110, as well as during potential periods of instabilities and vibration. Under certain operating conditions, the flexible glass substrate 92 can flex inwards, towards the primary roll member 110 and out of the handling surface envelope 97 as depicted in FIG. 2. However, because the center section 118 of the primary roll member 110 is offset radially inwards from the first cylindrical contact surface 112 and the second cylindrical contact surface 114, the flexible glass substrate 92 can flex inwards, towards the primary roll member 110 and out of the handling surface envelope 97 without contacting the primary roll member 110.

Referring to FIGS. 2 and 3, it has been determined through analytic modeling that the maximum inward flex of the flexible glass substrate 92 occurs at or near a tangent transition 108 in the conveyance direction where the glass ribbon assembly transitions from the planar orientation of the first glass conveyance path 104*a* to a curved orientation as the glass ribbon assembly 90 is directed around the primary roll member 110. Accordingly, the primary roll member 110 is designed such that the relief distance 119 measured radially from the first and second cylindrical contact surfaces 112, 114 to the center section 118 is greater than the maximum flex distance 99, defined as the maximum deflection of the flexible glass substrate 92 out of the handling surface envelope 97. In one embodiment, where the flexible glass substrate 92 is about 0.9 m wide, about 0.3 mm thick, the first and second handling tabs 95, 96 are about 0.075 mm thick on each side of the flexible glass substrate 92, and the primary roll member 110 is about 0.2 m in diameter, a relief distance 119 of about 3 mm is required to prevent contact between the flexible glass substrate 92 and the primary roll member 110. Other processing variables may affect the maximum flex dimension of the flexible glass substrate 92 including Young's modulus of the flexible glass substrate 92, thickness of the flexible glass substrate 92, draw tension applied to the glass ribbon assembly 90, and the angle at which the glass ribbon assembly 90 engages the primary roll member 110.

While FIG. 3 schematically depicts conveying the glass ribbon assembly 90 from a planar orientation to a non-planar orientation for the purpose of winding the glass ribbon assembly 90 onto a take-up roll 86, it should be understood that various other primary roll members 110 may be incorporated into the apparatus 100 at every location along the conveyance direction 102 where there is a tangent transition 108 between a planar orientation and a curved orientation. Other such locations are illustrated in FIG. 1 and include primary roll members 110 placed proximate to the pay-out roll 82 where the glass ribbon assembly 90 is conveyed from a non-planar orientation to a planar orientation. The pay-out roll 82 includes a take-out point 83 that is tangential to the glass conveyance path 104, similar to that described in regard to the take-up roll 86 hereinabove. Similarly, first and second primary roll members 110*a*, 110*b* are placed proximate to a functional roller 130, for example a cooling drum 88, having a generally large radius of curvature that defines a contact surface 134 which supports the glass ribbon assembly 90. Such a cooling drum 88 may be incorporated into an apparatus 100 used to process a glass ribbon assembly 90 through, for example, a vacuum sputtering process. As shown in FIG. 1, the glass ribbon assembly 90 is conveyed from a third glass conveyance path 104*c* having a planar orientation to a fourth glass conveyance path 104*d* having a non-planar orientation around the cooling drum 88, and back to a fifth glass conveyance path 104*e* having a planar orientation.

Figure 4:
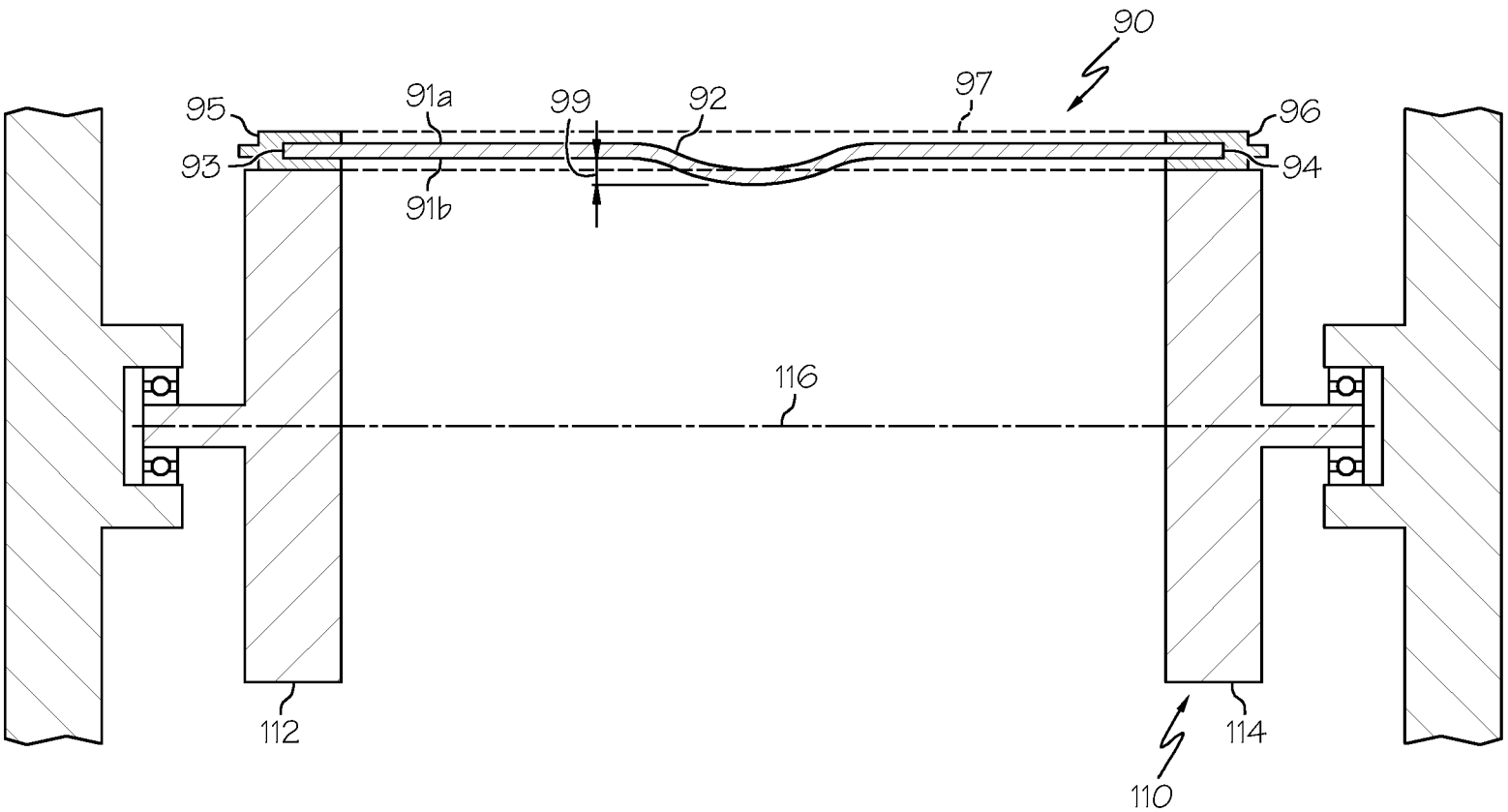
FIG. 4 schematically depicts a primary roll member and a glass ribbon assembly according to one or more embodiments shown or described herein.

Referring now to FIG. 4, another embodiment of the primary roll member 110 is schematically depicted. The first cylindrical contact surface 112 is spaced apart and separated from the second cylindrical contact surface 114 along the roller element axis 116. The first and second handling tabs 95, 96 of the glass ribbon assembly 90 are supported by the first and second cylindrical contact surfaces 112, 114 of the primary roll member 110 as the glass ribbon assembly 90 is conveyed along the conveyance direction 102. In this embodiment, the primary roll member 110 is formed without a center section, such as when the first and second contact surfaces are formed on independent disks. Similar to the embodiments discussed above in regard to FIGS. 2 and 3, the glass ribbon assembly 90 is supported such that the flexible glass substrate 92 is free to flex outside of the handling surface envelope 97 without contacting other elements of the apparatus.

Figure 5:
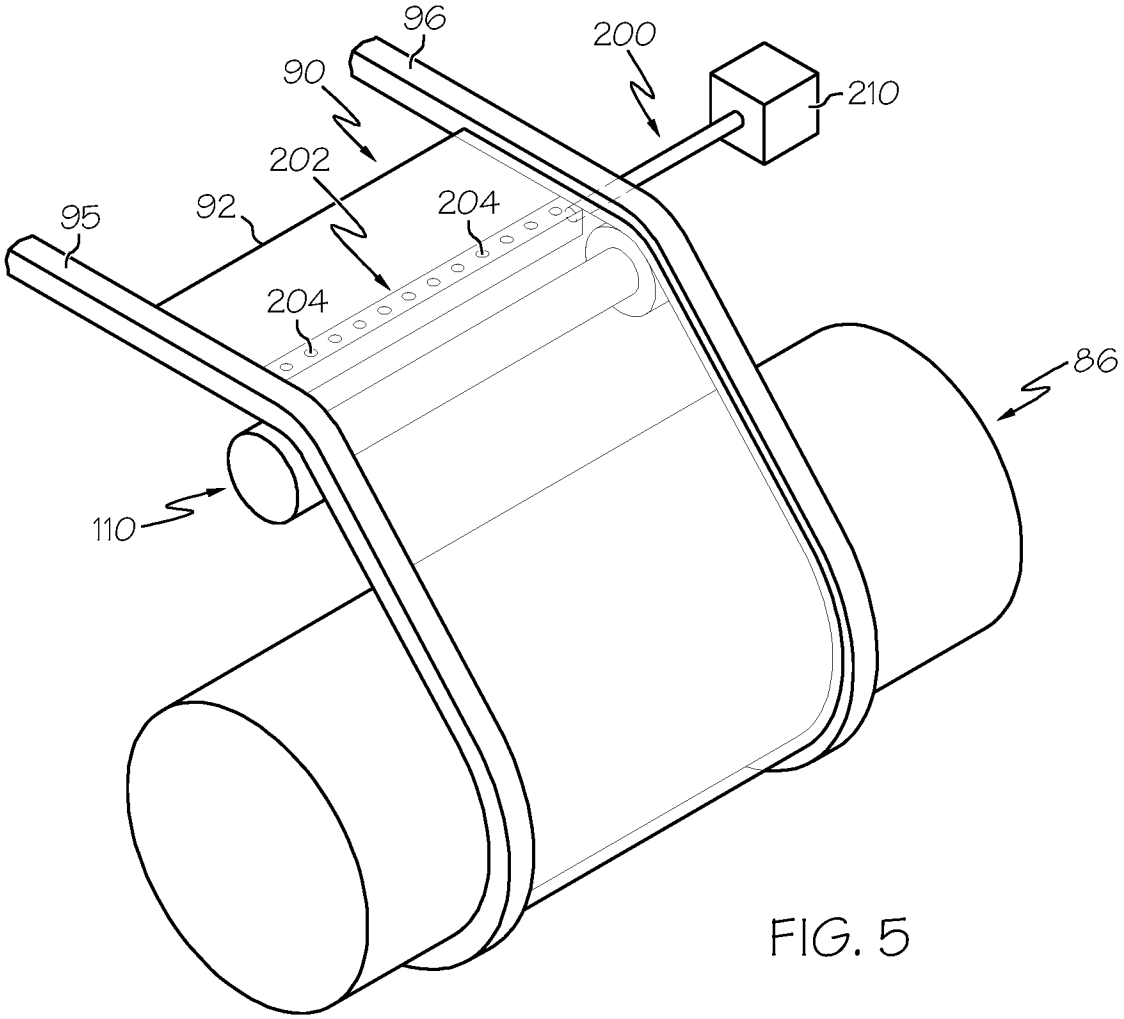
FIG. 5 schematically depicts a portion of an apparatus for conveying a glass ribbon assembly according to one or more embodiments shown or described herein.
Figure 6:
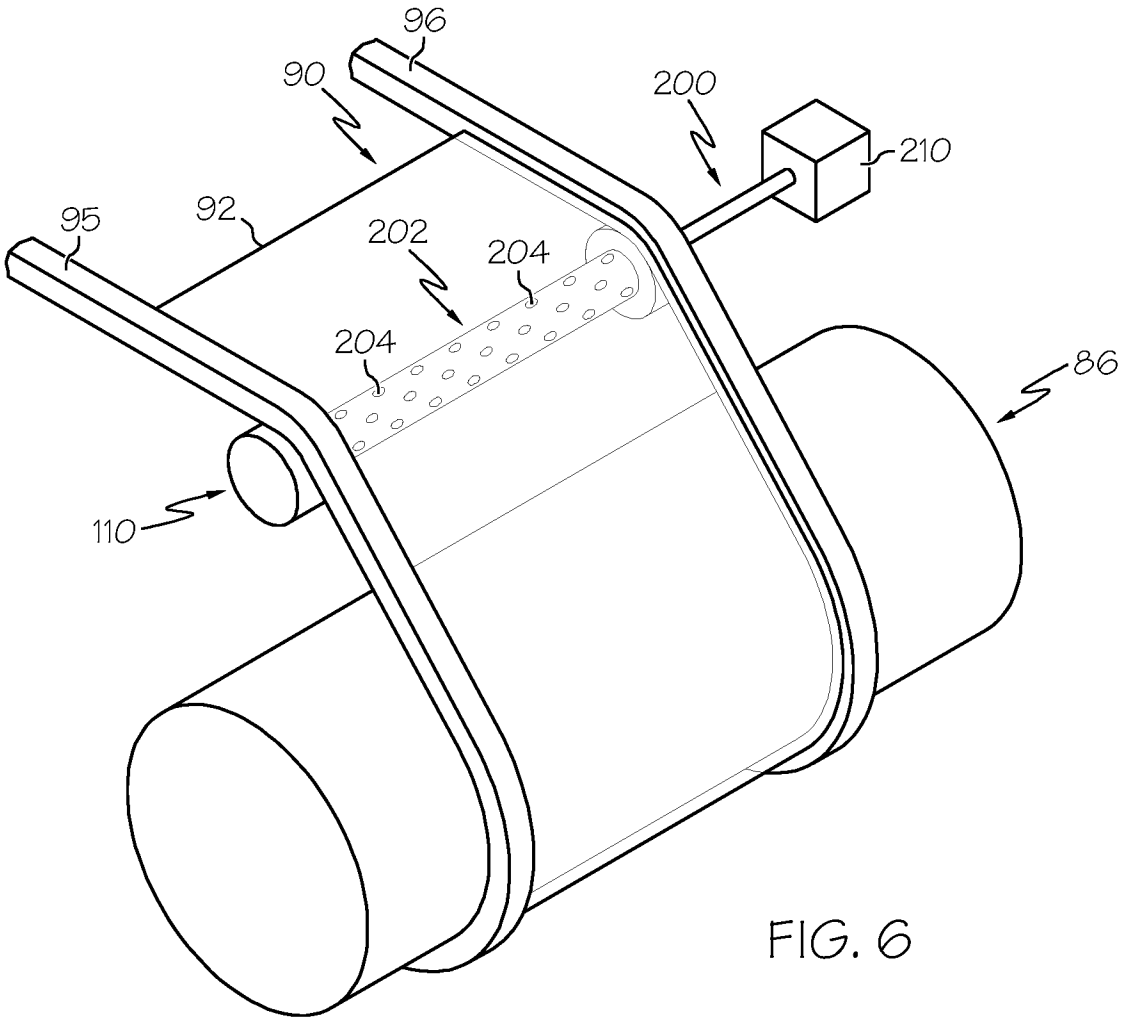
FIG. 6 schematically depicts a portion of an apparatus for conveying a glass ribbon assembly according to one or more embodiments shown or described herein.

Referring now to FIGS. 5 and 6, portions of alternate embodiments of the apparatus 100 are schematically depicted. In both embodiments, the apparatus 100 further includes a fluid support device 200 that supplies a fluid cushion to the flexible glass substrate 92 at a location between the first handling tab 95 and the second handling tab 96. The fluid support device 200 is coupled to a fluid plenum 210 that supplies a fluid, such as air, nitrogen, or the like, at an elevated pressure. The fluid cushion deflects the flexible glass substrate 92 in a radial direction away from the primary roll member 110 and supports the flexible glass substrate 92 over the primary roll member 110. In the embodiment depicted in FIG. 5, the fluid support device 200 includes a fluid injection bar 202 that is located upstream of the primary roll member 110. The fluid injection bar 202 includes a plurality of perforations 204 that emit a fluid cushion which deflects the flexible glass substrate 92 in a radial direction away from the primary roll member 110. In the embodiment depicted in FIG. 6, the fluid support device 200 is incorporated into the primary roll member 110, which includes a plurality of perforations 204 through the center section 118. The perforations 204 emit a fluid cushion that deflects the flexible glass substrate 92 in a radial direction away from the primary roll member 110. The perforations 204 of the fluid injection bar 202, as illustrated in FIG. 5, or of the primary roll member 110, as illustrated in FIG. 6, may be positioned across all or a portion of the width of the flexible glass substrate 92. The perforations 204 can be positioned to supply a fluid cushion that supports the flexible glass substrate 92 in locations required by the particular application.

Figure 7:
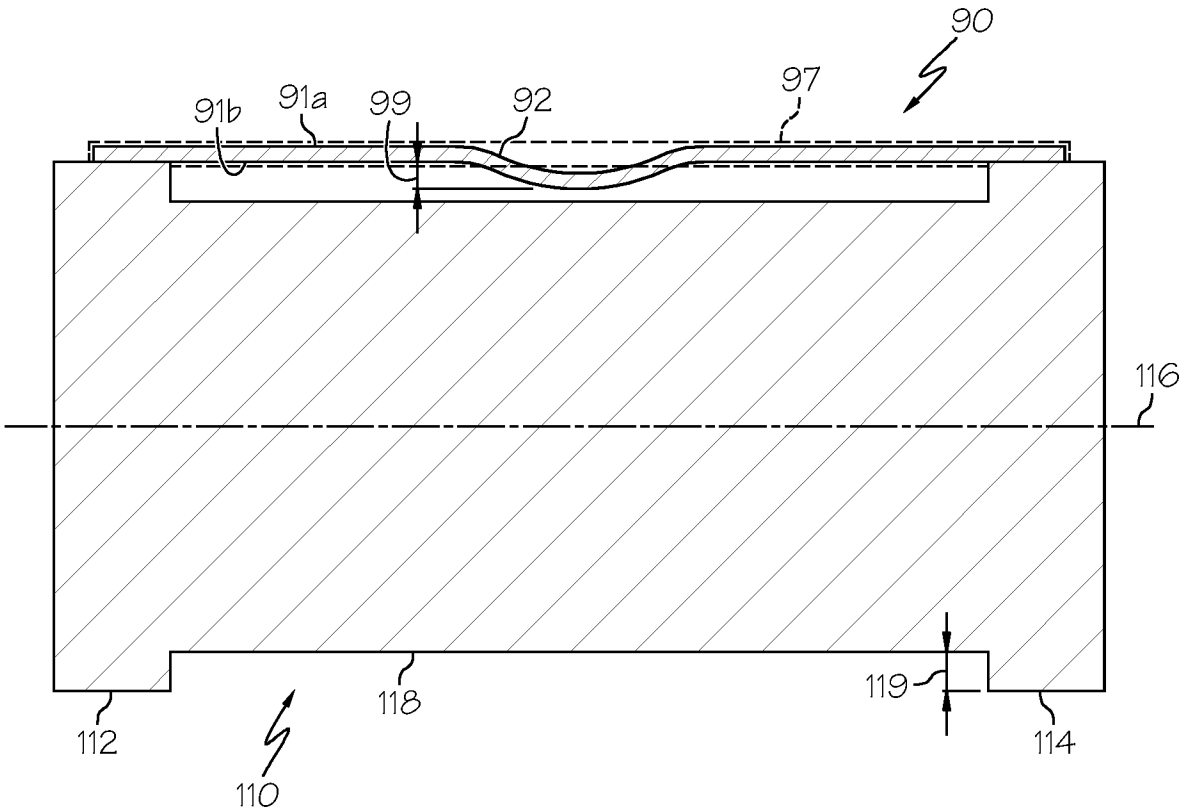
FIG. 7 schematically depicts a front view of a primary roll member and a glass ribbon assembly shown along line A-A of FIG. 1.

Referring now to FIG. 7, in some embodiments, the primary roll member 110 may be used to direct a glass ribbon assembly 90 that does not include first and second handling tabs from a first glass conveyance path 102*a* to a second glass conveyance path 102*b*. In these embodiments, the handling surface envelope 97 is defined by the first and second surfaces 91*a*, 91*b* of the flexible glass substrate 92 when the first and second surfaces 91*a*, 91*b* are planar. The glass ribbon assembly 90 contacts the first cylindrical contact surface 112 and the second cylindrical contact surface 114 of the primary roll member 110 at positions proximate to the first and second edges 93, 94 of the flexible glass substrate 92. The portion of the flexible glass substrate 92 positioned between the first and second cylindrical contact surfaces 112, 114 of the primary roll member 110 is free to flex out of the handling surface envelope 97 and remains spaced apart from the primary roll member 110 as the flexible glass substrate 92 is directed around the primary roll member 110.

While the methods and apparatuses described herein may be used in roll-to-roll processing of glass substrates, it should be understood that other applications are possible. For example, the methods and apparatuses may be used in conjunction with a glass manufacturing apparatus.

Figure 8:
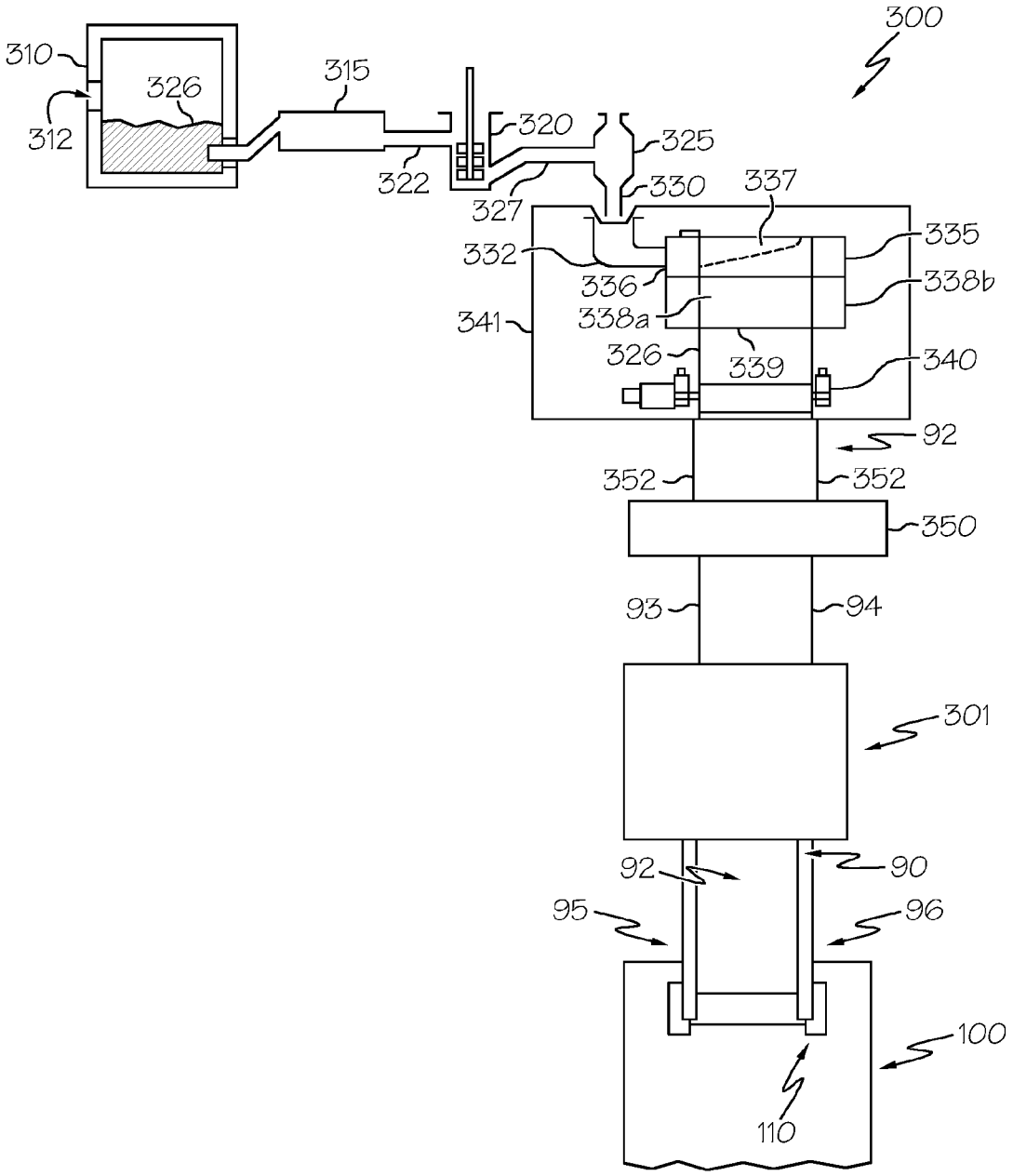
FIG. 8 schematically depicts an apparatus for forming a flexible glass substrate from molten glass and applying an adhesive tape ribbon to the edges of the flexible glass substrate to form a handling tab.

Referring now to FIG. 8, in one embodiment, the primary roll member 110 may be incorporated into a glass manufacturing apparatus 300 which produces a flexible glass substrate 92, from glass batch materials. The glass manufacturing apparatus 300 may include a melting vessel 310, a fining vessel 315, a mixing vessel 320, a delivery vessel 325, a fusion draw machine (FDM) 341 and a tab applicator 301 for forming handling tabs 374. Glass batch materials are introduced into the melting vessel 310 as indicated by arrow 312. The batch materials are melted to form molten glass 326. The fining vessel 315 has a high temperature processing area that receives the molten glass 326 from the melting vessel 310 and in which bubbles are removed from the molten glass 326. The fining vessel 315 is fluidly coupled to the mixing vessel 320 by a connecting tube 322. The mixing vessel 320 is, in turn, fluidly coupled to the delivery vessel 325 by a connecting tube 327.

The delivery vessel 325 supplies the molten glass 326 through a downcomer 330 into the FDM 341. The FDM 341 comprises an inlet 332, a forming vessel 335, and a pull roller assembly 340. As shown in FIG. 8, the molten glass 326 from the downcomer 330 flows into an inlet 332 which leads to the forming vessel 335. The forming vessel 335 includes an opening 336 that receives the molten glass 326 which flows into a trough 337 and then overflows and runs down two sides 338*a* and 338*b* before fusing together at a root 339. The root 339 is where the two sides 338*a* and 338*b* come together and where the two overflow walls of molten glass 326 rejoin (e.g., refuse) before being drawn downward by the pull roller assembly 340 to form the continuous flexible glass substrate 92.

As the flexible glass substrate 92 exits the pull roller assembly 340, the molten glass solidifies. In one embodiment, after the molten glass solidifies and cools, the flexible glass substrate 92 may be directed into a cutting device, such as a laser cutting device 350, which removes edge beads 352 formed on the flexible glass substrate 92 during the formation process by laser separation. However, it should be understood that this step is optional and that in other embodiments (not shown) the edge beads 352 may be left in place on the flexible glass substrate 390.

The flexible glass substrate 92 is then directed into a tab applicator 301 where an adhesive tape ribbon may be applied to the first and second edges 93, 94 of the flexible glass substrate 92. Upon exiting the tab applicator, handling tabs 95, 96 may be formed on the lateral edges 93, 94 of the flexible glass substrate 92 to create a glass ribbon assembly 90 and to facilitate handling the glass ribbon assembly 90 during downstream processing operations. Thereafter, the glass ribbon assembly 90 may be conveyed into apparatus 100 through additional downstream processing steps as described hereinabove. Accordingly, in this embodiment, the processing equipment upstream of the apparatus 100 can be collectively referred to as the glass ribbon assembly source.

It should now be understood that methods and apparatuses for conveying a glass ribbon assembly according to the present disclosure include primary roll members that support a glass ribbon assembly on first and second handling tabs positioned at the edges of the flexible glass substrate. The upper and lower surfaces of the handling tabs define a handling surface envelope. As the glass ribbon assembly is conveyed along a conveyance path and redirected from a first path to a second path around a primary roll member, the flexible glass substrate is free to flex outside of the handling surface envelope while remaining spaced apart from the primary roll member. Accordingly, by maintaining spacing between the flexible glass substrate and the primary roll member as the glass ribbon assembly is redirected, damage to the flexible glass substrate may be minimized. The purpose of the roll member design is to prevent contact between flexible glass substrate or device structures that are fabricated on the glass surfaces and the roll member. The roll member can act alone to redirect the glass direction. Alternatively, the roll member can be used to initiate or to complete a curved path of the glass ribbon assembly. The curved path initiated or completed with the roll member may then continue over other rollers placed in proximity to the roll member. It should be understood that the most likely location for contact between the flexible glass substrate and the roll member is in a location proximate to the transition of the glass ribbon assembly between a flat shape and a curved shape. When the glass ribbon assembly is conveyed in a straight direction, the flexible glass substrate may have a tendency to sag or bow. This deflection may be exacerbated or caused by instabilities in the overall mechanical system. The roll member design prevents or minimizes contact between the flexible glass substrate and the roll member. As the direction of glass conveyance between the roll member and other rollers in proximity to the roll member is along a conveyance path that is curved, the likelihood of contact is reduced. Further, any or all portions of the roll member may include a fluid support device, as described hereinabove.

Variations of the concept of use include the use of roll member designs in sheet-fed roller conveyance equipment configurations. Further, while handling tab configurations that are positioned above and below the flexible glass substrate were described above, other handling tab designs are contemplated. Use of roll members according to the present disclosure with a flexible glass substrate that does not include handling tabs is possible. In such applications, contact between the flexible glass substrate and the roll member is permissible along the edges of the flexible glass substrate, while the central portion of the flexible glass substrate remains free from contact with the roll members.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. An apparatus for redirecting a glass ribbon assembly from a first glass conveyance path to a second glass conveyance path, the apparatus comprising:

a glass ribbon assembly source for providing the glass ribbon assembly comprising a flexible glass substrate that includes a first surface and a second surface that extend laterally between a first edge and a second edge, a first handling tab affixed to the first edge, and a second handling tab affixed to the second edge, wherein the first handling tab and the second handling tab extend above and below the flexible glass substrate and define a handling surface envelope;

a primary roll member located downstream of the glass ribbon assembly source, the primary roll member comprising a first cylindrical contact surface and a second cylindrical contact surface spaced apart from the first cylindrical contact surface along a roller element axis, wherein the flexible glass substrate of the glass ribbon assembly is free to flex out of the handling surface envelope while remaining spaced apart from the primary roll member when the glass ribbon assembly is directed around the primary roll member; and wherein the first glass conveyance path extends from the glass ribbon assembly source to the primary roll member, the first cylindrical contact surface and the second cylindrical contact surface of the primary roll member tangential to the first glass conveyance path, and the second glass conveyance path extends from the primary roll member in a downstream direction, the first cylindrical contact surface and the second cylindrical contact surface of the primary roll member tangential to the second glass conveyance path and wherein the second glass conveyance path is non-planar with the first glass conveyance path.

2. The apparatus of claim 1, further comprising a drive mechanism for applying a draw tension to the glass ribbon assembly that feeds the glass ribbon assembly along the first glass conveyance path and the second glass conveyance path.

3. The apparatus of claim 1, further comprising a functional roller downstream of the primary roll member.

4. The apparatus of claim 3, wherein the functional roller is a cooling drum.

5. The apparatus of claim 1, wherein the primary roll member further comprises a center section positioned between the first cylindrical contact surface and the second cylindrical contact surface, and the center section of the primary roll member is offset radially inwards from the first cylindrical contact surface and the second cylindrical contact surface by a relief distance.

6. The apparatus of claim 5, wherein the center section of the primary roll member includes a plurality of perforations coupled to a fluid plenum.

7. The apparatus of claim 1, further comprising a second primary roll member comprising a first cylindrical contact surface and a second cylindrical contact surface spaced apart from the first cylindrical contact surface along a roller element axis, wherein the second primary roll member is positioned downstream of the primary roll member.

8. The apparatus according to claim 7, further comprising a functional roller between the primary roller member and the second primary roll member.

9. The apparatus of claim 1, wherein the glass ribbon assembly source comprises a glass manufacturing apparatus.

10. The apparatus of claim 1, further comprising a fluid support device that supplies a fluid cushion to the flexible glass substrate at a location between the first handling tab and the second handling tab.

11. The apparatus of claim 10, wherein fluid support device is arranged such that the fluid cushion will deflect the flexible glass substrate in a radial direction away from the primary roll member and support the flexible glass substrate over the primary roll member.

12. The apparatus of claim 10, wherein the fluid support device comprises a fluid injection bar located upstream of the primary roll member.

* * * * *